United States Patent [19]

Eickmann

[11] 4,377,965

[45] Mar. 29, 1983

[54] ARRANGEMENT OF A CONTROL BODY

[76] Inventor: Karl Eickmann, 2420 Isshiki, Hayama-machi, Kanagawa-ken, Japan

[21] Appl. No.: 116,353

[22] Filed: Jan. 28, 1980

[51] Int. Cl.[3] ..... F01B 13/06

[52] U.S. Cl. ..... 91/487

[58] Field of Search ..... 91/487, 491, 498

[56] References Cited

U.S. PATENT DOCUMENTS 3,280,757 10/1966 Eickmann ..... 91/498

3,960,060 6/1976 Eickmann ..... 91/487

*Primary Examiner*—William L. Freeh

[57] ABSTRACT

In a number of patents my former art of control bodies which have centric and eccentric portions are disclosed for the passing and control of flow of fluid into and out of working chambers in fluid handling devices, such as fluid pumps, motors, compressors, transmissions.

The invention discovers, that those control bodies of the former art under certain circumstances tend to rotate slightly by a few degrees under friction in the control mirror and then stick very strongly their seats whereby they lose their ability to adjust themselves axially and for good seal under small friction along the stationary control face of the rotor.

The invention overcomes this problem by providing a retainer on a stationary portion in the device to prevent the control body from any rotation around one of its axes. The smooth operation of the control body is thereby assured and the former sticking and loss of ability to operate perfectly is overcome.

5 Claims, 22 Drawing Figures

286
87
86
82
186
95
83
93
89
85
23
81
90
84
94
91
95
86
286
186
95
86
11
99
98

186
86
87
81,82
1
89
91
1
90

2
1
82
85
1
2
86
86
95
91
1
95
87
181

7
V
8
9
93
88
82,81
83
85
3
6
5
105
95
87
95
3
11
4
133
11,12
84
94
9
8
86
92
87
91
132
131
V 12
83
93
82
4
11
11
12
12
12
94
84
82
85
12
11
4
12

ARRANGEMENT OF A CONTROL BODY

REFERENCE TO RELATED PATENTS

This patent application is closely related to my U.S. Pat. Nos.: 3,398,698; 3,831,496; 3,850,201; 3,889,577; but it is an independend new patent application and no division or continuation of the mentioned patents. No priorities of the above mentioned patents are claimed for this present application.

BACKGROUND OF THE INVENTION

A great number of control bodies of the patents mentioned under reference to related patents have been actually built and practically applied. The mathematical backgrounds and details of such control bodies were very highly developed and explained it detail in the mentioned patents. The so build and applied control bodies worked perfectly under usual applications but at certain applications a difficulty appeared. The reasons for the difficulty could for a long time not be found. At certain higher revolutions and slightly high "fb"-factors, it was found upon disassemblies of the control bodies after they had run for a time, that they were sticking in their seats and not any more axially feathering.

But, when a light hammer was used to give a blow to the respective control body, the control body suddenly started to feather again and was then again easily moveable by hand within the axial movement provided by the design to the control body.

The present invention inquires deeply into the problem and finds the reason for the described sticking of the control bodies. After the reason of the undesired sticking has been found by the inquiries of this invention, which needed many years to perfect, the invention now discloses details, how the undesired sticking of the control bodies can be overcome.

FIELD OF THE INVENTION

This invention deals exclusively with control bodies which have centric and eccentric portions. There are many other kind of control bodies, partially known from other of my elder U.S. patents. For example those for radial flow fluid control and axially operating thrust pistons. These however do not belong to the field of this present invention.

The control bodies of the field of the present invention have a stationary control face wherealong the rotary control face of the fluid handling rotor closely sealing slides, when the rotor of the pump, compressor, motor or transmission or engine revolves. Passages are led through the control body to end in thrust chambers behind the respective shoulders of the control body. The thrust chamber or chambers press the control body towards and against the mentioned rotary control face. The respective thrust chamber is bordered by at least one centric and at least one eccentric portion of the control body or by two eccentric portions of the control body.

DESCRIPTION OF THE PRIOR ART

In reference to related patents the former art of the control bodies of the prior art is mentioned. Most of the former art are patents of my elder inventions. My former art discloses, that the control mirror between the stationary and rotary control face has a pressure centre of a distance "Ge" from the medial axis. My elder patents disclosed mathematical formulas to calculate the thrust chambers and control body portions in such a way, that they form pressure centres gci "and gco" or gci "or gco" of an equal distance from the medial centre line, equal to the distance Ge of the control mirror. The former art thereby brought an absolutely perfect method for the design of control bodies, whereby the control body should float free of tilting tendencies between pressure centres on its ends.

The control bodies of the former art in fact did so. They floated exactly between the pressure centres on their ends. However the former art did not recognize, that additional and other actions would also appear on the control body, which would restrict or prevent the operation of the axial free floating between equal pressure centres.

SUMMARY OF THE INVENTION

The invention discovers, that another kind of actions appears on the control bodies, which has nothing to do with the equalizing of the pressure centres of the former art.

This new action is a sticking of the portions of the control bodies in their seats under very small angles between neighbouring faces. The mentioned very small angles increase the forces between the neighbouring faces in such a style as a cone of a very sharp small angle would, when a respective cone body would be inserted into a respective coned hole.

The new discovery is more in detail described by the explanatory FIGS. 20 to 22.

In short, the appearance, discovered by the invention, is, as follows:

In the control mirror between the stationary and rotary control face a slight friction occurs, because a seal of relative to each other moving faces, can never be without any friction, even, when the friction is very small. This friction trends to revolve the control body in the direction of rotation of the rotary control face. The O-ring seals of the control body prevent such rotation and large eccentricities of the eccentric control body portion prevent it too, in practical application. The radial sizes of the machines are however reducing very considerably with the improvements by many of my other patents in order to reduce the weight and size of devices of a certain power. Thereby the control bodies are receiving more and more reduced radial dimensions and eccentricities. The eccentricities are becoming sometimes so small, that they and the seals of the control bodies do not fully prevent any rotation of the control body any more. The respective control body may then rotate about 1 to 4 degrees in the direction of the movement of the rotary control face. Thereby however, the control body relocates itself a few thousandth or hundredth of a millimeter radially and finally sticks between at least one eccentric and another concentric or eccentric seat. Under the very small angles of less than one degree the friction force transfered to the control body is multiplied several hundred or thousand times. The control body then sticks so fast, that it can not any more free itself.

By the present invention, the described problem has been discovered and the invention now finds, that it is required to prevent the slightest possibility of rotation of the control body. The invention therefore discovers too, that the sticking already appears at one or a very few degrees of rotation. The invention therefore aims, to restrict any rotation of the control body to such small limits, that the faces of the control bodies can not come to a sticking between the respective faces of the seats, wherein the control body is kept. In other words, the invention restricts the probable rotation of the control body to such a small extent, that the faces of the control body and of the seats can never actually meet or touch.

In this connection, the invention also discovers, that means must be provided to prevent such rotation and that the means so to be provided must be of such a nature, location and design, that they are able to keep the rotational movement of the control body within the permissible maximums of limits.

The objects, arrangements and means of the invention, to achieve the aim of the invention may be different embodiments, suiting the respective control body arrangements and may become expressed in concise words in the following concise description of the invention.

CONCISE DESCRIPTION OF THE EMBODIMENTS

The embodiments of the invention may be described in a concise form, as follows:

(A) An arrangement of a control body having centric and eccentric portions, in a device which contains working chambers which contain fluid and wherein said device has passages for leading fluid to and from said working chambers; at least one thrust—chamber for the reception of at least a portion of said control body, a rotary control face ported by said passages, a stationary control face on said control body, interrupted by control ports which are connected to portions of said passages and a thrust bearing means for axially bearing a fluid handling body of said device and thereby defining the axial location and fixing of said rotary control face, while fluid under pressure in said thrust chamber presses said control body towards said fluid handling body and thereby said stationary control face into sealing engagement on said rotary control face, whereby said faces seal and slide along each other when one of said bodies revolves relatively to the other of said bodies and and pressure is present in fluid in said at least one thrust chamber;

wherein a retainer is provided in said device and engaging said control body to prevent rotation of said control body relatively to said thrust chamber. or; as:

(B) The arrangement of A, wherein said retainer is at least one pin which is fastened in a stationary portion of said device and engaged into a hole in said control body. or; as:

(C) The arrangement of A, wherein said retainer is an arresting member having a non-circular portion and said control body includes a non-circular space of a configuration complementary to said non-circular portion, wherein said arresting member is non-rotatably fastened on a stationary portion of said device, and, wherein said non-circular portion is axially moveably entered and fitted into said non-circular space. or; as:

(D) The arrangement of A, wherein said device includes a holding part and said control body includes an arresting part, wherein said parts form portions of said retainer, wherein one of said parts is provided with an extension;

wherein the other of said parts is provided with an at least partially open room, and, wherein said extension is at least axially moveably fitted into said partially open room. or; as:

(E) The arrangement of D, wherein said holding part is an insertion provided in said device and able to be fastened to a stationary portion of said device, and, wherein said holding part is adjustable at least in a limited extent relatively to said stationary portion in the direction of rotation around an axis of said control body. or; as:

(F) The arrangement of C, wherein said arresting member is adjustable relatively to said stationary portion in at least a limited extent in the direction of rotation around an axis of said control body. or; as:

(G) An arrangement of a control body having centric and eccentric portions, in a device which contains working chambers which contain fluid and wherein said device has passages for leading fluid to and from said working chambers; at least one thrust-chamber for the reception of at least a portion of said control body, a rotary control face ported by said passages, a stationary control face on said control body, interrupted by control ports which are connected to portions of said passages and a thrust bearing means for axially bearing a fluid handling body of said device and thereby defining the axial location and fixing of said rotary control face, while fluid under pressure in said thrust chamber presses said control body towards said fluid handling body and thereby said stationary control face into sealing engagement on said rotary control face, whereby said faces seal and slide along each other when one of said bodies revolves relatively to the other of said bodies and and pressure is present in fluid in said at least one thrust chamber;

wherein said control body includes a differential space of at least two different cross-sectional dimensions;

wherein said space contains axially moveably and fitting therein a differential body of two different cross-sectional areas;

wherein a medial chamber is formed in said space along portions of said differential body, wherein said medial chamber is communicated to a room in said device of substantial low pressure; and, wherein one end of said space is communicated through a portion of said control body and through said stationary control face for alternating communication to said passages, while the other end of said space is communicated to said at least one thrust chamber, whereby said differential body adapts its axial location in said space in response to the pressures in fluid in said ends of said space. or; as:

(H) An arrangement of a control body having centric and eccentric portions, in a device which contains working chambers which contain fluid and wherein said device has passages for leading fluid to and from said working chambers; at least one thrust-chamber for the reception of at least a portion of said control body, a rotary control face ported by said passages, a stationary control face on said control body, interrupted by control ports which are connected to portions of said passages and a thrust bearing means for axially bearing a fluid handling body of said device and thereby defining the axial location and fixing of said rotary control face, while fluid under pressure in said thrust chamber presses said control body towards said fluid handling body and thereby said stationary control face into sealing engagement on said rotary control face, whereby said faces seal and slide along each other when one of said bodies revolves relatively to the other of said bodies and and pressure is present in fluid in said at least one thrust chamber;

wherein at least one insert is provided from a portion of said control body through said at least one thrust chamber into a stationary portion of said device. or; as:

(M) The arrangement of H, wherein said insert provides a closed cross-sectional area through said thrust chamber in a desired extent at at a desired location to prevent the entrace of pressure in fluid in said thrust chamber into said cross-sectional area at said location. or; as:

(N) The arrangement of H, wherein said insert extends into seats in said control body and said stationary portion, wherein spaces are formed endwards of said insert in said seats, wherein a passage extends through said insert, and, wherein said spaces communicate through a portion of said control body with a fluid under a pressure different from the pressure in said thrust chamber. or; as:

(J) An arrangement of a control body having centric and eccentric portions, in a device which contains working chambers which contain fluid and wherein said device has passages for leading fluid to and from said working chambers; at least one thrust-chamber for the reception of at least a portion of said control body, a rotary control face ported by said passages, a stationary control face on said control body, interrupted by control ports which are connected to portions of said passages and a thrust bearing means for axially bearing a fluid handling body of said device and thereby defining the axial location and fixing of said rotary control face, while fluid under pressure in said thrust chamber presses said control body towards said fluid handling body and thereby said stationary control face into sealing engagement on said rotary control face, whereby said faces seal and slide along each other when one of said bodies revolves relatively to the other of said bodies and and pressure is present in fluid in said at least one thrust chamber;

wherein said thrust bearing means is an at least partially hydrostatic bearing provided with fluid from at least one of said chambers;

wherein said bearing includes at least one one-way valve, and, wherein said at least one valve communicates to at least one adjacent fluid pressure pocket of said thrust bearing. or; as:

(K) The arrangement of J, wherein said bearing includes a plurality of fluid-pressure pockets sealing lands therealong, bearing lands therebetween, and, wherein at least two of said pockets are communicated with each other. or; as:

(L) The arrangement of G, wherein said control body is divided into portions to facilitate the provision of said space and to insert said differential body into said differential space.

The word "embodiment" defines in this specification a respective embodiment of the invention.

Figure 18:
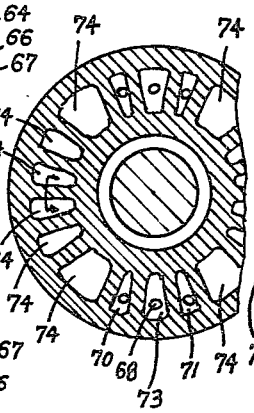
FIG. 18 is a sectional view through FIG. 16 along line XVIII—XVIII.
Figure 17:
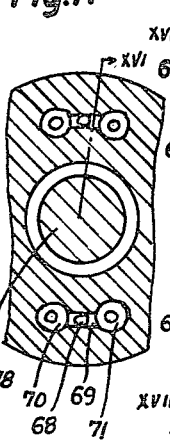
FIG. 17 is a sectional view through FIG. 16 along line XVII—XVII.
Figure 16:
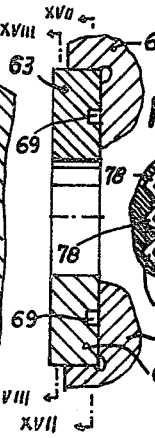
FIG. 16 shows a separated portion of FIG. 15.
Figure 19:
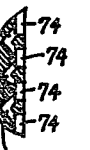

FIG. 19 is a sectional view in part along the arrow in FIG. 18. The mentioned arrow in FIG. 18 has no number, because there is no space for it in the figure.

DESCRIPTION OF THE PREFERRED EMBODIMENTS

Control body 81 in the figures has at least one centric portion 82 which contains the control parts 83 and 84 and ends in the stationary control face 85. The control body 81 is partially contained in a housing portion, cover portion, in short, in a stationary portion 86 of the device, or of the machine.

Control body 81 has also at least one eccentric shoulder 87. It may have another portion, namely an end portion 88 which may be either a centric or an eccentric portion. End portion 88 may have another size or direction of eccentricity than the eccentric portion or shoulder 87. Control body 81 may have passages and commonly has passages 89,90 for the passing of fluid therethrough. It can however also be, that the control body 81 has only control ports, but no passages in accordance with this invention. For example, when the control body merely deals for sealing, and controling, but not for passing of fluid.

The respective stationary portion 86 forms at least one partially centric chamber 91 which forms a first pressure chamber 91. The stationary portion 86 may also form a second chamber 92 to become a second pressure chamber 92. The mentioned pressure chamber or chambers receive a respective portion or portions of the control body 81. Fluid is led through entrances or exits 93,94 into one or all respective chambers 89,90 and thereby transform the mentioned pressure chambers into thrust chambers 91,92. The pressure in fluid in the respective thrust chamber 91,92 or both, acts to press the control body 81 towards the rotary control face of the rotor which is known from the mentioned former art, to seal therealong, and to let the rotary control face 98 slide along the stationary control face 85, when the rotary control face 98 revolves.

Each thrust chamber is radially bordered by at least one eccentric portion of control body 81. The stationary portion 86 forms respective seats for the respective control body portion. Seals, mostly O-rings of 90 code quality, namely 95, may be inserted to seal between the respective portion of control body 81 and the respective seat and thereby to seal the respective thrust chamber 91 or 92.

As explained in great detail in my mentioned former art patents, the pressure centre "gco" or "gci" of the respective thrust chamber 91 or 92 must be equal to the pressure centre Gc of the respective control face 85 of the control body.

So far, except the control body which has only ports, namely ports 83 and 84, but no passages 89,90, the matter described here, is known from my mentioned older patents and thereby former art in this present application.

Figure 1:
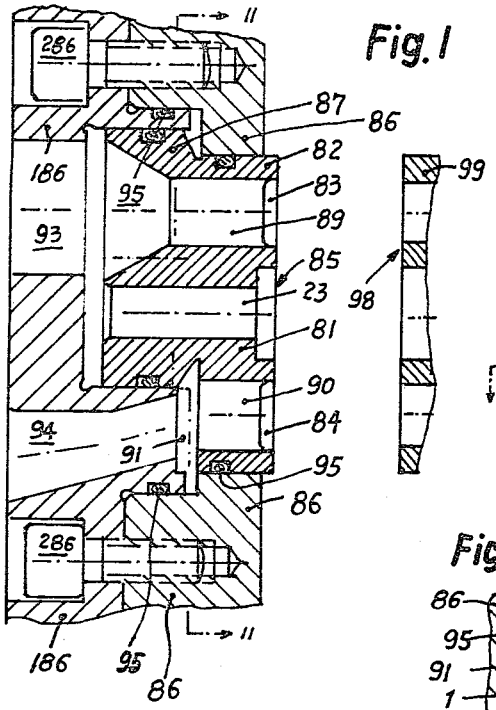
FIG. 1 is a longitudinal section view through one embodiment.
Figure 2:
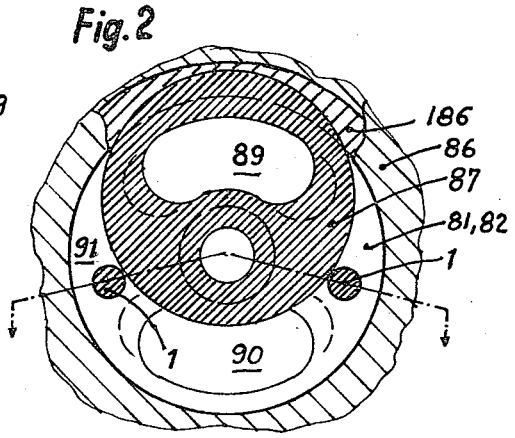
FIG. 2 is a sectional view through FIG. 1 along line II—II.
Figure 3:
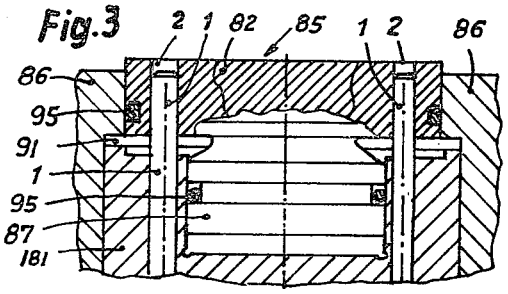
FIG. 3 is a sectional view through FIG. 2 along line III—III.

What is novel in accordance with this invention, and thereby part of this invention, are the following arrangements:

The FIGS. 1 to 3 show at least one novel retainer, F.e.:1, which is associated to the stationary portion 86 or 186 and to the control body 81 to restrict the possible mini-rotation of the control body 81 to a limit, which is so small, that the outer faces of the control body can never meet or touch the faces of the seats on the stationary portion 86 or 186 wherein the respective portions of the control body are borne or kept.

In FIGS. 1 to 3 this novel retainer 1,2 consists of at least one pin 1, which is fastened in the stationary portion 86 and which engages in a respectively dimensioned hole 2 in control body 81. In FIGS. 1 to 3 there are two of said at least one pin and these two pins 1 engage into respective holes or bores 2 in a respective portion, for example 82 or 87 or 88 of control body 81. They thereby extend, as FIGS. 1, 2 and 3 show, through a respective thrust chamber, for example, 91. To make the arrangement work, the pins 1 and the bores 2 must be so accurately set and the clearances between them must be kept so accurate and so small, that the angular maximum of rotation of control body 81 is kept by the meeting of the pins 1 on the walls of bores 2 within that very small range of rotation of only a very few or less degrees before the outer faces of the control body can ever get a chance to meet the inner faces of the respective seats in the stationary portion 86. Thus, the accuracy of the setting of pins 1 and of bores or holes 2 must commonly be within an accuracy of 6 or 8 hundredth of a millimeter and the clearance between the pins 1 and the walls of holes 2 must commonly be below 3 or less hundredth of a millimeter. Otherwise the arrangement would bring no aim of the invention, but on the contrary would act to disturb the already good device of the former art.

For those enterprises which have obtained respective machines or drawings from the inventor, the required accuracy of the pins and bores described here can be easily met. For those enterprises which did not obtain respective machineries from the inventor, it is recommended to meet the required accuracy by setting the pivotably adjustable stationary portion 186 into the stationary portion 86 to keep the pins 1 in the adjustable stationary portion 186 and to adjust the portion 186 angularily accordingly, so, that the outer face portions of control body 81 are centered in their respective seats in portion 86 and 186. The adjustable portion 186 is then in this position fastened by holder means or bolts 286 on the non-adjustable stationary portion 86. The required accuracy of setting and adjustment of the pins 1 in bores 2 is then materialized, when the adjustment operation is correctly carried out.

Figure 4:
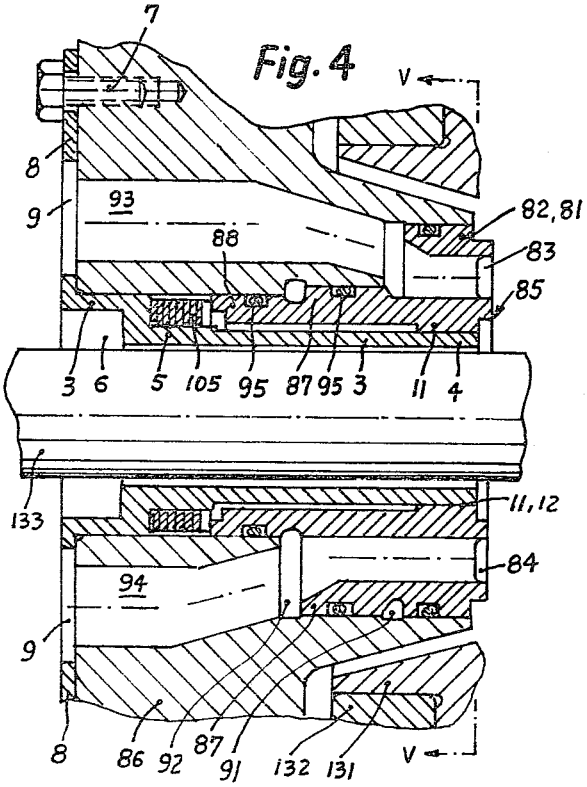
FIG. 4 is a longitudinal sectional view through another embodiment.
Figure 5:
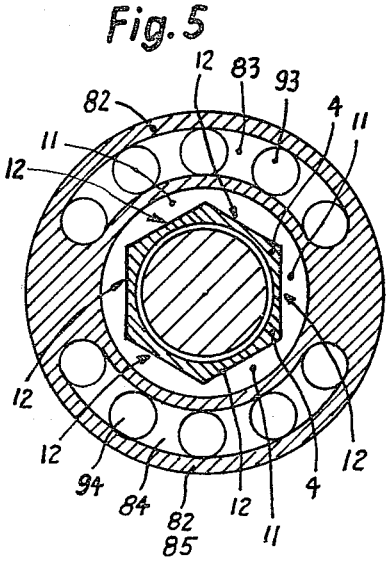
FIG. 5 is a sectional view through FIG. 4 along line IV—IV.

FIGS. 4 and 5 demonstrate, that the retainer in this embodiment is an arresting member 3 in combination with a respectively formed space in a portion 11. Arresting member 3 forms a non-circular portion 4 which engages into a in the figures in visible space of a corresponding non-circular complementary configuration on or in a control body portion 11. The non-circular portion 4 of arresting member 3 is axially moveably fitted into the complementary configurated space in control body portion 11. The arresting member 3 is fastened by holding means or bolts 7 in the stationary portion 86 of the device. For those enterprises which have not obtained accurate manufacturing machine tools from the inventor it is recommended, to make the arresting member 3 angularly adjustable. That can be done in any case, even, when accurate manufacturing machine tools have been obtained. The angular adjustment can be done even from the outside of the device when the arrangements of the figures of the invention are fully followed. Arresting member 3 may for that purpose get an extension or portion 8 of appropriate radial size to be able to do the adjustment remote from the portions 4 and 11 in an enlarged scale.

For reasons of compactness, price or simplicity, the arresting member 3 may also be provided with seats 6 for the reception of shaft seals and with seats 5 for the holding of the thrust springs 105 which may be commercially available wavespring rings. The arresting member 3 may also form seats 9 in the end portion 8 to receive O-rings for the sealing of the connections to the entrances and exits 93 or 94. The accuracy must be kept within the limits described by FIGS. 1 to 3.

The multi-angular shape, for example hexangular-face shapes of the non-circular configuration of portions 4 and 11, which engage visibly in FIG. 4 and more visibly in FIG. 5 by faces 12, are especially convenient to fullfil the aim of the invention and to be simple in machining.

Figure 8:
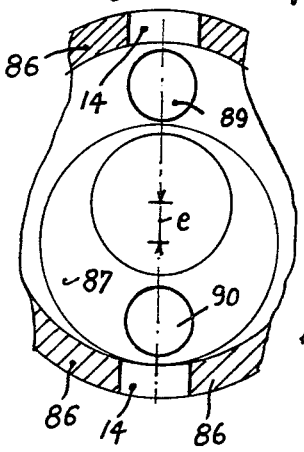
FIG. 8 is a sectional view through FIG. 6 along line VIII—VIII.
Figure 7:
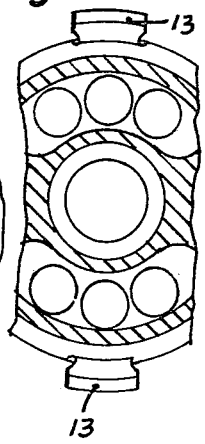
FIG. 7 is a sectional view through FIG. 6 along line VII—VII.
Figure 6:
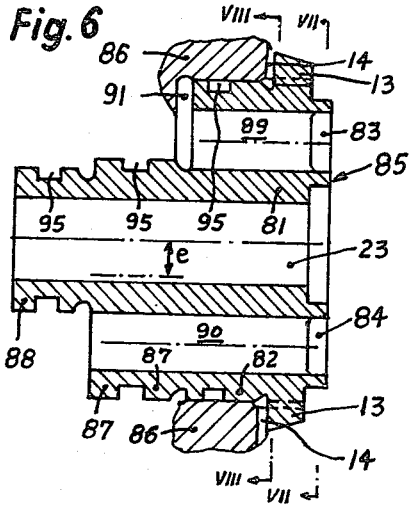
FIG. 6 is a longitudinal sectional view through a third embodiment.

In the embodiment of FIGS. 6 to 8 the retainer of the invention consists of the combination of a holding part and an arresting part. Either the control body 81 or the stationary portion 86 is provided with the arresting part and the other with the holding part. For example, the arresting part may be the at least one finger 13 on the control body portion 82 and the arresting part may be a recess 14 in stationary portion 86. The dimensions must be so accurate, that the fit of the part 13 in part 14 is so close, that the control body 81 can not rotate more than the limit described by FIGS. 1 to 3 limits.

Figure 9:
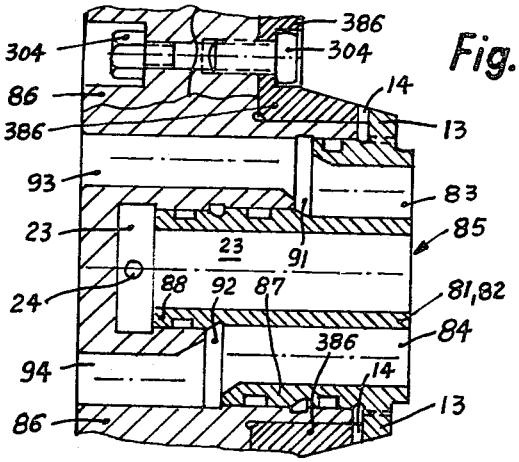
FIG. 9 is a longitudinal sectional view through a fourth embodiment.

For convenience of manufacturing or for those which did not obtain accurate machine tools from the inventor, it is suggested to make the arresting part or the holding part or both adjustable. This can be seen by way of example in the embodiment shown in FIG. 9. Holding portion 386 can be fastened by holding means 304 on the stationary portion 86 after the respective small angular adjustment for centering the portions of control body 81 in their seats.

The holding part and the arresting part of the FIGS. 5 to 9 then keep the control body closely fit into centered location in the respective seats and the said parts 13 and 14 are then closely fitting relatively on each other or to each other and they are still permitting the required axial moveability of the parts relatively to each other. Thus, the aim of the invention is fulfilled. The control body 81 can still move in axial direction but is prevented from rotation over the small limit in which the outer faces of the control body do not meet and not touch the seats in the stationary portion 86.

Figure 20:
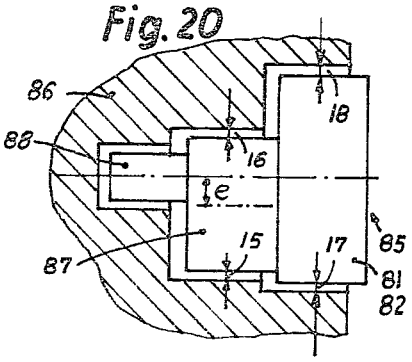
FIG. 20 is a longitudinal view through a schematic explanation.
Figure 21:
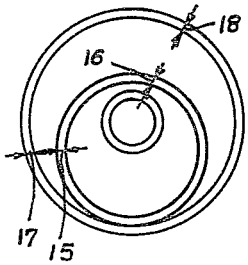
FIG. 21 shows the clearances of FIG. 20 in a very enlarged scale.
Figure 22:
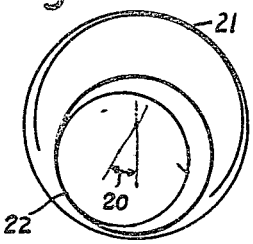
FIG. 22 explains in a schematic, wherein all radial matters are shown in very enlarged scale, which illustrates the dislocation and sticking of the control body which are discovered by the present invention.

To understand the heretofore described important embodiments of the invention, wherein the sizes and configurations may be changed and the locations may be changed within the scope of the invention, the explanatory FIGS. 20 to 22 are supplied in this specification.

FIG. 20 demonstrates the usual, centred location of control body 81 in the stationary portion 86. Between control body 81 and stationary portion 86 the radial clearances 17,18,15,16 are shown in a very drastically enlarged scale to explain the problem. The clearances shown here in the figures in a size of more than a millimeter are actually in high pressure devices less than 0,05 millimeter. Because otherwise the plastic O-rings 95 can not seal any more under high pressure of several hundred atmospheres. They would be pressed through the clearance and come out from the end of the respective clearance as a thin black sheet like a paper sheet, when the clearances would be wider than the said 0,05 mm. Less resistant O-rings 95, for example, those of 70 code, would come out as thin black ring sheets already at pressures about 100 atmospheres, when the clearances (radial clearances) 15 to 18 or those, not mentioned on portion 88, would be wider than 0,05 millimeter.

When now the eccentricity of the control body portion 87 is very small, which means, that "e" in FIG. 20 is very small, then the friction along the control face 85 trends to revolve the controlbody 81, clockwise in FIG. 22, when the rotary face revolves clockwise in the figures along the stationary control face 85 of the figures. The outer face of the centric portion 82 of control body 85 then meets the face of the seat in the area of referential 21. At the same time the bottom portion of the outer face of the eccentric portion 87 meets the face of the seat in the area of referential 22. The meeting of the faces in the areas 21 and 22 occures under very small angles of commonly less than one degree. When the angle of meeting of the faces would be an angle of 90 degrees the force of friction, say for example 0,2 Kgm would be the same at the meeting of the faces. But, since in this application the angle between the meeting faces is not 90 degrees but in practice less than a few or less than one single degree, the force multiplies. It can in this specific application multiply a hundredfold or even thousandfold, because of the very small angle of the meeting of the faces. Thus, while the friction force may be only in the area of 3 to 100 Kilograms depending on size of the control face and thrust chambers, the force in the meeting places 21 and 22 may become many tons and thereby stick the control body 81 so fast in the seats, that it is no more able to loosen itself therefrom.

The angle of rotation, at which the meeting at places 21 and 22 and thereby the sticking of the control body in its seats takes place is in FIG. 22 also shown in a very drastic enlarged scale to make it visible. Actually the meeting and sticking in places 21 and 22 takes place already at 2 to 8 degrees of rotation of the control body 81 relatively to stationary portion 86. The actual degree depend on the size and configuration. The angle at which the meeting and sticking at 21 and 22 appears is so small, that it can not be seen in the figures, when the figures would be written in a 1:1 actual scale. The same applies to the sizes of the clearances. It should be understood here, that the matter which is discussed here is not visible to the human eye, because the problems take place in such narrow sizes, that the human eye is hardly able to see or to discover them. The whole invention is thus, merely a mathamatical consideration, which has taken many years to gain the maturity which led to this invention.

In this connection it should be recognized, that it is true, that the friction in the control clearance or on the stationary control face is the primary cause for the rotation of the control body 81. But the force of this primary cause is so small relatively, that it is not strong enough to stick the control body 81 in the seats in the stationary portion 86.

The actual sticking comes from the relation of the eccentricity "e" relatively to the outer diameters of the control body portions 82,87,88. When the eccentricity "e" is relatively big in this relation, for example, as in my U.S. Pat. No. 3,889,577, then the control body 81 commonly does not stick in stationary body 86. The plastic force of the O-rings 95 is strong enough then to prevent the rotation in a too wide extent.

But, when the eccentricity "e" is small relatively to the outer diameters of control body portions 82,87 or 88, for example, as in my U.S. Pat. No. 3,850,210, the limit for rotation becomes so small and the angle of the meeting of the faces becomes so small, that the sticking actually appears and appears with a very great force.

Thus, what the invention discovered, is, that the rotation of the control body must become limited to a smaller degree, than that where the meeting of the faces in 21 and 22 would take place. The arrangements of the invention must therefore be of such an accuracy to limit the possibility of rotation of the control body to degrees which are less than the angle 20 in FIG. 22, where the sticking appears in such a strength, that the control body can no more loosen itself.

Figure 10:
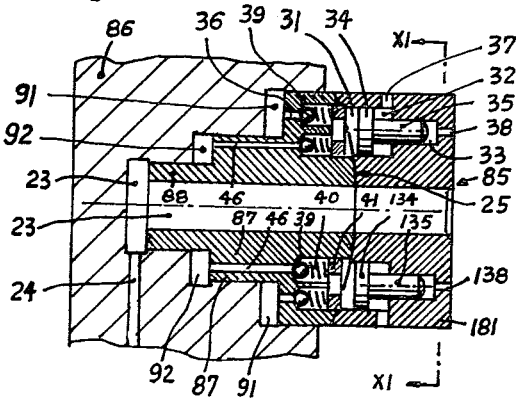
FIG. 10 is a longitudinal sectional view through a fifth embodiment.
Figure 11:
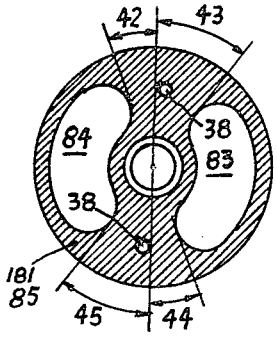
FIG. 11 is a sectional view through FIG. 10 along line XI—XI.

The embodiment shown in FIGS. 10 and 11 can be combined with the other figures of the invention or also be embodied in the controlbodies of the patents of my former art or in control bodies of the future probably too.

It sets a passage into the control arc of the control face. The control arc is the area of angles 42–43 on top of the face and of angles 44–45 on the bottom portion of the control face, as demonstrated in FIG. 11. Control arc portion 43 is wider than portion 42 in order to build up a pre-pressure in the working chamber when the same revolves over the closing arc. In the bottom portion the angle 45 is wider than 44 in order to permit a gradual pressure reduction in the working chamber which revolves at the respective time over the closing arc or control arc on the bottom portion of the figure.

Control body 81 contains according to this embodiment of the invention a differential space of two different dimensions, namely 31 and 32 and a differential body fitted and moveable therein, which has two different dimensions 34 and 35. Commonly the space is a differential cylinder and the body is a differential piston fitted axially moveable in the differential cylinder. Thereby a wider space 31 is formed and communicated by passage 36,46 to thrust chamber 91 or 92. A smaller space 33 is formed on the other, the smaller, end of the differential piston 34,35 and communicates by passage 38, 138 to the control arc 42–43 or 44–45 of the control face 85. A medial space 32 appears between the medial portion of the differential body 34–35 and the differential space 31–33 and is shown by referential 32. This medial space 32 is communicated by passage 37 to a room of substantial no pressure in the device in order to prevent any restriction of freedom of differential body 45–35 by this medial space 32. When the respective working chamber, for example 55 of FIG. 15, revolves over the closing—or control—arc 42–43 or 44–45, the pressure in the working chamber is different or temporary different from the pressure in the thrust chambers 91 or 92. The differential piston 34–35 is then adapted to different pressures on its ends out of rooms or spaces 31 and 33. Under these pressures the differential piston 35–34 moves accordingly within the spaces 31,32,33 and thereby reduces the rapidity of change of pressure in the respective working chamber of the device. This reduction of change of rapidity of change of pressure reduces the vibrations and noise of the machine or device very perceptibly. Especially when more than 1 of the differential spaces and bodies of this embodiment of the invention are applied.

In case of multiple supply of differential spaces and differential bodies with respective communications 31 to 38, it is recommended to use of different dimensions and different ratios between the smaller and the wider portions. Because thereby a stepwise pressure build-up or pressure reduction in the respective working chamber(s) becomes possible and that is a very effective means to reduce vibrations and noise in the machine. The details of this technology are very extensive and should be requested from the inventor, whose address is mentioned on the patent. These details have developed through many decades of time consuming and costly research.

When multiple thrust chambers 91 and 92 are provided and the control body 81 is adapted to work with both of them, multiple communications of chamber or space 31 are suggested. One passage means 36 to thrust chamber 91 and another passage means 46 to thrust chamber 92. One way or check-valves 39 with loaders or springs 40 or respective directional communication valves of my earlier patents should then be set between space 31 and thrust chambers 91 or 92 to communicate the respective space 31 to the higher loader thrust chamber, but to discommunicate it temporarily for the respective time from the respective thrust chamber 91 or 92 which has at that time lower load or pressure. Holders 41 may be inserted to fasten or pre-compress the respective springs 40 when these are applied.

To facilitate an easy manufacturing of the spaces 31–33 and to insert the bodies 34–35 thereinto or also to permit a spherical adjustment of the control face 85, it is suitable to divide the control body into a front portion 181 and a rear portion 81. The front portion, and 181 is then laid upon the face 25 of the rear portion, prevented from rotation thereon for example by a bore and a pin therein and sealed thereon for example by a respective complementary configuration. The bearing face 25 may either be spherical, which means, a ball-part formed portion or face or a plane face. When it is spherical the radius of the faces 25 should be large in comparison to the the diameter of the control body. Because at a too small radius with a too stiff ball-part form there are appearing radial actions out of the control ports or passages 83,84,89,90 which can dislocate the control body or disturb its desired actions. The former art has seldom recognized the disastrous effects of too siffly formed spherical swing beds.

Figure 14:
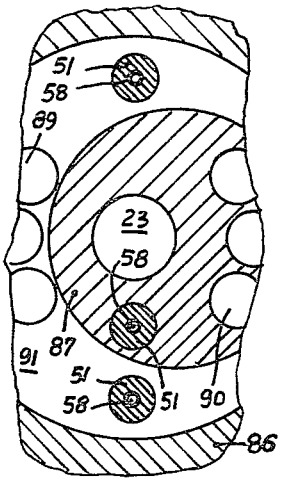
FIG. 14 is a sectional view through FIG. 12 along line XIV—XIV.
Figure 13:
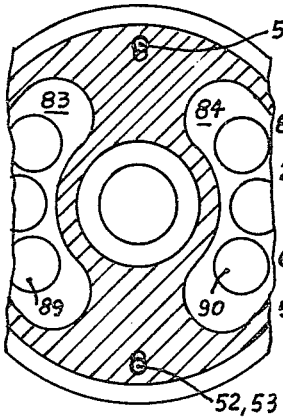
FIG. 13 is a sectional view through FIG. 12 along line XIII—XIII.
Figure 12:
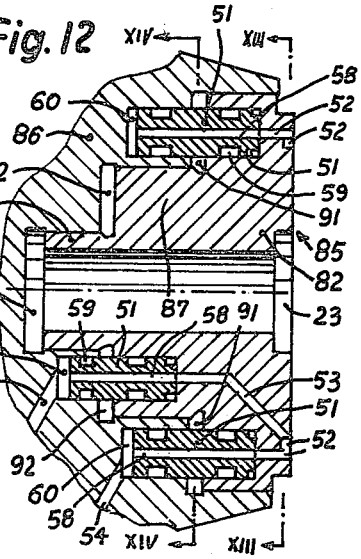
FIG. 12 is a longitudinal sectional view through a sixth embodiment.

The embodiment of FIGS. 12 to 14 deals with a very different problem.

Figure 15:
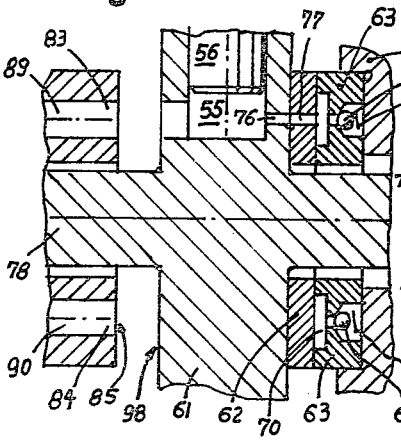
FIG. 15 is a longitudinal sectional view through a seventh embodiment.

When the respective working chamber of the machine, for example, working chamber 55 of FIG. 15, revolves over the closing arc or control arc, for example, 42–43 or 44–45 of FIG. 11, the passage 57 for example of FIG. 15, extends the control port 83 or 84 over a portion of the control arc 42 etc. This extension is called by the angle gamma in the calculations and mathematics of my former art patents.

The present invention now recognizes, that this angle gamma is not constant but changing gradually with the rotation of the rotary control face over the stationary control face 85. Thereby it appears in accordance with the present invention, that the pressure centres "Gc", "gci" and "gco" or at least the pressure centres "Gc" along the stationary control face 85 can not be the constants, assumed in the former art, but are variable. Consequently, the "gci" and "gco" values can never be equal at all times to the value "Gc". Since the value "Gc" is variable, while the values "gci" and "gco" were fixed values.

The stationary control face 85 can consequently not fully locally float equally along the rotary control face as the patents of my former art assumed. It is agreed that the difference from the desired perfect local equality of floating is minimal in actual devices. But it can become important at high pressures and speeds.

Accordingly the invention discovers, that the variable area of the angle gamma in the control arc should be eliminated from the thrust chamber 91 or 92. That is done by the insertion of insert 51 into controlbody 81 and stationary portion 86. The insert 51 extends then through the respective thrust chamber 91 or 91 and thereby takes the cross-sectional area of the insert 51 away from the thrust chamber 91 or 92. Instead it sets a chamber, space or seat 60 on an end of the insert 51, for example in the stationary portion 86. In other words, it takes the area of the variable angle gamma away from the thrust chamber and provides a space with variable pressure corresponding to the variability of the area effected by the angle gamma on another place, different from the respective thrust chamber 91 or 92. When multiple inserts 51 are provided and communicated by passages 52,58 or 53 the variability of the actions due to the variability of gamma can become lessened to a certain extent. The negative influence of the variability of gamma thus taken away from the thrust chambers 91 and 92 becomes generally reduced, whereby the floating of face 85 is improved.

The more inserts of smallest diameters are set, the better is the adjustment in response to the variable angle gamma. The inserts 51 must be enerted into respective seats in the control body 81 and in the stationary portion 86 in order to eliminate the thrust chamber 91 or 92 from its-cross-sectional area. Respective seals seats 59 may be therefore provided and receive seals or O-rings. The inserts 51 for different thrust chambers 91 or 92 may receive different locations and different locations of the passages 52,53. Passages 52 may end distanced from the control ports 83,84 to receive the communication with the respective rotor passage of the rotary control face for a respectively short enough time. Spaces 60 may be communicated by passages 58 through inserts 51 with passages 52 or 53 to the control face 85.

The inserts 51 and their seats in the control body 81 and in the stationary portion 86 may also serve as the retainers or the pins and holes of the embodiment of FIGS. 1 to 3.

Some of the figures demonstrate, that end-chambers 23 and insides of control bodies 81 should be communicated by passages 24 to spaces under substantially low or no pressure in order to eliminate negative actions from the interior of the control body to the control face 85.

Spaces 60 of FIGS. 12 to 14 could also be otherwise communicated by additional passges 54, but commonly that is not often desired, because chambers 60 may under temporary varification of gamma receive a medial pressure which improves the smoothness of operation of the control face 85, because it reduces the differences of forces appearing in the control arc portions by the variation of angle gamma. The influence of gamma is not great in the control part areas 83–84, but greater in the control-arc areas 42 to 45.

The embodiment of FIGS. 15 to 19 demonstrates, that care of the control arc area situation should also be extended to hydrostatic bearings, which may be provided on the other end of the rotor in co-operation with the control body.

Rotor 61 of the machine has working chambers 55 with displacement members 56 co-operating with them. Passages 57 extend to the rotary control face 98, wherealong the stationary control face 85 of the control body 81 slides and seals thereon.

Rotary control face 98 and stationary control face 85 are sliding closely along each other with a clearance of commonly one or a few hundredth of a millimeter. But in FIG. 15 they are shown wide apart in order to make it visible that there are two faces 98 and 85. Because in a drawing in scale both faces would appear as a single line, since a clearance of a hundredth of a millimeter can not be drawn in a figure. Since the control face 85 presses against the rotary face 89 the rotor would be pressed rightward in FIG. 15 when the rotor 61 would not be borne on a bearing on the other rotor-end. Consequently the bearing 62–63 is provided on the other end of rotor 61 and held in a stationary portion 64 of the housing or cover of the machine or device.

When bearing 62–63 is a hydrostatic bearing, the provision of a single angular bearing fluid pressure pocket with sealing lands is suitable only for limited pressures and revolutions. For a perfect device for higher pressures and revolutions however, the embodiment of the invention of FIGS. 15 to 19 should be applied. That is, that a plurality of single fluid pressure pockets 74 etc must be set with a great number of bearing lands 75 therebetween. Bearing lands 75 should be lubricated from two ends out of neighbouring fluid pressure pockets 74. The fluid pressure supply into pockets 74 and the other might appear through passages 76 and 77 through the rotor 61 and bearing portion 62, when a portion 62 is applied. The single fluid pressure pockets 74 should be communicated with each other through passages 78 of FIG. 19.

According to the teaching of the variable angle gamma in the closing arcs or control arcs 42 to 45 of this invention, the respective fluid pressure pockets 73,70 and 71 of the bearing should not be supplied by pressure pockets 74 but be supplied with fluid separated from them. Under certain circumstances the fluid pressure pockets in the region of the closing arcs or control arcs 42–45 may be combined to a single fluid pressure reception set 70 to 73. For that purpose one-way valves 66 with loading means 67 may be set into the passages to pockets 70 or 71. A recess 69, visible in FIGS. 16 and 17, may communicate pockets 70, 73 and 71 over the one-way valve of the higher or timed pressure. Other communications or restrictions are possible, when they remain within the scope of the invention. The embodiment improves the smoothness of action of the bearing and makes it capable of higher pressures and revolutions.

The description of the preferred embodiments is given under use of the referentials in the description of the preferred embodiments. But a concise description of the embodiments without the use of referential numbers is also given under the chapter "summary of the invention" in this specification. Therein "A" describes the embodiments of FIGS. 1 to 9. Therein "B" describes the embodiment of FIGS. 1 to 3. Therein "C" describes the embodiment of FIGS. 4 to 5. Therein "D" describes the embodiment of FIGS. 6 to 9. Therein "E" describes the adjustment arrangement of FIG. 9. Holder 304 therein may be fastened only from inside of the device or extend through stationary portion 86 for fastening or adjustment from outside of the device. In the "summary of the invention", the portion "F" describes the adjustment and fastening arrangement of FIG. 4. Therein "G" describes the arrangement of FIGS. 10 and 11. Therein "H" describes the embodiment of FIGS. 12 to 14.

Therein "M" deals with the areas of the embodiment of FIGS. 12 to 14. Therein "N" deals with the passages, seats and spaces in the embodiment of FIGS. 12 to 14 and describes then. Therein "I" describes the embodiments of FIGS. 16 to 19. Therein "K" deals with and describes details of the embodiment of FIGS. 16 to 19, and therein "L" deals with the division of the control body of the embodiment of FIG. 10 and describes the same.

Further details of some of the embodiments may obtain the following concise description:

O; The arrangement of G,
wherein
said control body is divided into a front-portion and a rear portion, and,
wherein
said front portion contains said stationary control face and said control ports,
wherein
said rear portion has said centric portion and said eccentric portion,
wherein
said front portion forms on its back a first face, the rear portion forms on its front a second face,
wherein
said faces are complementary relatively to each other, and,
wherein
said rear portion bears said front portion,
whereby
said first face is borne on said second face and seals thereon,
while
means are provided between said portions of said control body to prevent rotation of said front portion relatively to said rear portion. or; as:

P; The arrangement of G,
wherein
plural thrust chambers are communicated by separated passages to said one of said ends of said space and,
wherein
one-way valves are provided between said one end and said passages to discommunicate the respective thrust chamber of less pressure relatively to the higher loaded thrust chamber from said one end of said space. or; as:

Q; The arrangement of A,
wherein
said retainer is provided with an extension,
wherein
said extension extends to the outside of the device, and,
wherein
said extension includes a fastening portion which can be adjusted and be fastened from the outside of the device in order to precisely fix the said control body into its desired medial angular direction and prevent it from rotation relatively to said stationary portion of said device.

I claim:

1. An arrangement of a control body having centric and eccentric portions, in a device which contains working chambers which contain fluid and wherein said device has passages for leading fluid to and from said working chambers; at least one thrust-chamber for the reception of at least a portion of said control body, a rotary control face ported by said passages, a stationary control face on said control body, interrupted by contrl parts which are connected to portions of said passages and a thrust bearing means for axially bearing a fluid handling body of said device and thereby defining the axial location and fixing of said rotary control face, while fluid under pressure in said thrust chamber presses said control body towards said fluid handling body and thereby said stationary control face into sealing engagement on said rotary control face, whereby said faces seal and slide along each other when one of said bodies revolves relatively to the other of said bodies and when pressure is present in fluid in said at least one thrust chamber;
wherein
a retainer is provided in said device and engaging said control body to prevent rotation of said control body relatively to said thrust chamber,
wherein
said device includes a holding part and said control body includes an arresting part,
wherein
said parts form portions of said retainer,
wherein
one of said parts is provided with an extension;
wherein
the other of said parts is provided with an at least partially open room,
wherein
said extension is at least axially moveably fitted into said partially open room,
wherein
said holding part is an insertion provided in said device and able to be fastened to a stationary portion of said device, and,
wherein
said holding part is adjustable at least in a limited extent relatively to said stationary portion in the direction of rotation around an axis of said control body.

2. An arrangement of a control body having centric and eccentric portions, in a device which contains working chambers which contain fluid and wherein said device has passages for leading fluid to and from said working chambers; at least one thrust-chamber for the reception of at least a portion of said control body, a rotary control face ported by said passages, a stationary control face on said control body, interrupted by control ports which are connected to portions of said passages and a thrust bearing means for axially bearing a fluid handling body of said device and thereby defining the axial location and fixing of said rotary control face, while fluid under pressure in said thrust chamber presses said control body towards said fluid handling body and thereby said stationary control face into sealing engagement on said rotary control face, whereby said faces seal and slide along each other when one of said bodies revolves relatively to the other of said bodies and when pressure is present in fluid in said at least one thrust chamber;
wherein
a retainer is provided in said device and engaging said control body to prevent rotation of said control body relatively to said thrust chamber,
wherein
said retainer is an arresting member having a non-circular portion and said control body includes a non-circular space of a configuration complementary to said non-circular portion, wherein said arresting member is non-rotatably fastened on a stationary portion of said device, wherein said non-circular portion is axially moveably entered and fitted into said non-circular space, and, wherein said arresting member is adjustable relatively to said stationary portion in at least a limited extent in the direction of rotation around an axis of said control body.

3. An arrangement of a control body having centric and eccentric portions, in a device which contains working chambers which contain fluid and wherein said device has passages for leading fluid to and from said working chambers; at least one thrust-chamber for the reception of at least a portion of said control body, a rotary control face ported by said passages, a stationary control face on said control body, interrupted by control ports which are connected to portions of said passages and a thrust bearing means for axially bearing a fluid handling body of said device and thereby defining the axial location and fixing of said rotary control face, while fluid under pressure in said thrust chamber presses said control body towards said fluid handling body and thereby said stationary control face into sealing engagement on said rotary control face, whereby said faces seal and slide along each other when one of said bodies revolves relatively to the other of said bodies and when pressure is present in fluid in said at least one thrust chamber;

wherein a retainer is provided in said device and engaging said control body to prevent rotation of said control body relatively to said thrust chamber, wherein said retainer is provided with an extension, wherein said extension extends to the outside of the device, and, wherein said extension includes a fastening portion which can be adjusted and be fastened from the outside of the device in order to precisely fix the said control body into its desired medial angular direction and prevent it from rotation relatively to said stationary portion of said device.

4. An arrangement of a control body having centric and eccentric portions, in a device which contains working chambers which contain fluid and wherein said device has passages for leading fluid to and from said working chambers; at least one thrust-chamber for the reception of at least a portion of said control body, a rotary control face ported by said passages, a stationary control face on said control body, interrupted by control ports which are connected to portions of said passages and a thrust bearing means for axially bearing a fluid handling body of said device and thereby defining the axial location and fixing of said rotary control face, while fluid under pressure in said thrust chamber presses said control body towards said fluid handling body and thereby said stationary control face into sealing engagement on said rotary control face, whereby said faces seal and slide along each other when one of said bodies revolves relatively to the other of said bodies and when pressure is present in fluid in said at least one thrust chamber;

wherein said centric and eccentric portions of said control body are of cylindrical configurations around at least two different but to each other parallel axes of said portions, said centric and eccentric portions are axially slidably mounted with close fits in respective hollow cylindrical spaces of complementary centric and eccentric location and size respectively and relative to said centric and eccentric portions, wherein a retainer is located in said device for engagement of said control body to prevent rotation of said control body relatively to said thrust chamber, wherein said retainer is an arresting member having a non-circular portion and said control body includes a non-circular space of a configuration complementary to said non-circular portion, wherein said arresting member is non-rotatably fastened on a stationary portion of said device, and, wherein wherein said non-circular portion is axially moveably entered and fitted into said non-circular space.

5. An arrangement of a control body having centric and eccentric portions, in a device which contains working chambers which contain fluid and wherein said device has passages for leading fluid to and from said working chambers; at least one thrust-chamber for the reception of at least a portion of said control body, a rotary control face ported by said passages, a stationary control face on said control body, interrupted by control ports which are connected to portions of said pssages and thrust bearing means for axially bearing a fluid handling body of said device and thereby defining the axial location and fixing of said rotary control face, while fluid under pressure in said thrust chamber presses said control body towards said fluid handling body and thereby said stationary control face into sealing engagement on said rotary control face, whereby said faces seal and slide alone each other when one of said bodies revolves relatively to the other of said bodies and when pressure is present in fluid in said at least one thrust chamber;

wherein said centric and eccentric portions of said control body are of cylindrical configurations around at least two different but to each other parallel axes of said portions, said centric and eccentric portions are axially slidably mounted with close fits in respective hollow cylindrical spaces of complementary centric and eccentric location and size respectively and relative to said centric and eccentric portions, wherein a retainer is located in said device for engagement of said control body to prevent rotation of said control body relatively to said thrust chamber, wherein said close fits permit an angular pivotion of said control body relatively to said hollow cylindrical spaces within right and left angular boundaries at which said control body would become sticking in said hollow cylindrical spaces and become unable to slide achsially in said hollow cylindrical spaces due to said sticking, wherein said engagement includes at least one member engaging into an outcut with limited angular space between said member and the wall(s) of said outcut, wherein said limited angular space resstricts the angular pivotability of said engagement to a smaller angle than the angle of said angular pivotion permitted by said close fits is, whereby said angular pivotion of said control body is restricted to a smaller pivotion than said pivotion between said right and left boundaries, whereby said sticking of said control body in said right and left boundaries is prevented and the free axial moveability of said control body remains secured, wherein said retainer is an arresting means having a non-circular space and said control body includes a non-circular portion of a configuration complementary to said non-circular space wherein said arresting means is non-rotatably united with a stationary portion of said device, and, wherein said non-circular portion is axially moveably entered and fitted into said non-circular space.

* * * * *